US009689235B1

(12) United States Patent
Ayotte

(10) Patent No.: US 9,689,235 B1
(45) Date of Patent: Jun. 27, 2017

(54) SAFE, DIRECTIONAL, DROUGHT-RESISTANT DUG WELL (SDDW)

(71) Applicant: Joseph D. Ayotte, Concord, NH (US)

(72) Inventor: Joseph D. Ayotte, Concord, NH (US)

(73) Assignee: The United States of America as Represented by the Secretary of the Department of the Interior, Washington, DC (US)

( * ) Notice: Subject to any disclaimer, the term of this patent is extended or adjusted under 35 U.S.C. 154(b) by 491 days.

(21) Appl. No.: 14/488,097

(22) Filed: Sep. 16, 2014

Related U.S. Application Data

(60) Provisional application No. 61/980,503, filed on Apr. 16, 2014.

(51) Int. Cl.
*E21B 43/04* (2006.01)
*E21B 7/04* (2006.01)
*E21B 43/10* (2006.01)

(52) U.S. Cl.
CPC ..... *E21B 43/04* (2013.01); *E21B 7/04* (2013.01); *E21B 43/10* (2013.01)

(58) Field of Classification Search
CPC combination set(s) only.
See application file for complete search history.

(56) References Cited

U.S. PATENT DOCUMENTS 4,160,481 A 7/1979 Turk et al.
4,553,595 A 11/1985 Huang et al.
4,601,335 A * 7/1986 Murahashi ..... E21B 43/04 166/242.1
4,838,353 A 6/1989 Anders
4,878,539 A 11/1989 Anders
5,099,917 A 3/1992 Roser
5,161,914 A * 11/1992 Rahn ..... E21B 43/305 405/128.2
5,197,543 A 3/1993 Coulter
5,211,234 A 5/1993 Floyd
5,992,524 A 11/1999 Graham
(Continued)

OTHER PUBLICATIONS

Florida Department of Environmental Protection Bureau of Water Facilities Regulation, Monitoring Well Design and Construction Guidence Manual, 2008, whole document.*
(Continued)

*Primary Examiner* — Kyle Armstrong
(74) *Attorney, Agent, or Firm* — James M Mitchell

(57) ABSTRACT

A well structure for providing drinking water. The well structure includes slotted horizontal collectors connected laterally to a fitting connector. A well casing is connected to a top of the fitting connector. The fitting connector is positioned in a bottom of the well bore such that the horizontal collectors are perpendicular to groundwater flow. Crushed stones are deposited in a lower portion of the well bore and allow groundwater to flow down and into the slots of the horizontal collectors. A geotextile filter fabric is placed over the crushed-stone fill. A pump is placed in the well casing to pump the groundwater to the land surface. A loam soil fill is deposited over the geotextile filter fabric. A seal is placed around the well casing under the land surface. A vented, removable cap with a rubber seal is placed over a top of the well casing and secured.

20 Claims, 4 Drawing Sheets

(56) References Cited

U.S. PATENT DOCUMENTS

2004/0211559 A1 10/2004 Nguyen et al.

OTHER PUBLICATIONS

Fact Sheets on Environmental Sanitation. "Fact Sheet 2.5: Infiltration Galleries." Health Library for Disasters. http://helid.digicollection.org/en/d/Js13461e/2.5.html#Js13461e.2.5 (accessed Mar. 5, 2014).
Wilkins-Wells, Katherine. "How about Horizontal Water Wells?" Nov. 30, 2011. http://nwksgmd4.blogspot.com/2011/11/how-about-horizontal-water-wells_30.html.
"Bank Filtration for Water Treatment." http://www.wrrc.hawaii.edu/bulletins/2000_68/filtration.html (accessed Mar. 5, 2014).
"Taking on Surface Sources." Waterline. Winter 1995-1996. Minnesota Department of Health. http://www.health.state.mn.us/divs/eh/water/com/waterline/featurestories/mankato.html.
"Advanced Horizontal Collector Wells." http://krieter.com.my/?page_id=122 (accessed Mar. 5, 2014).

* cited by examiner

AMOUNT OF WATER IN STORAGE (IMMEDIATELY AVAILABLE IN A TRADIATIONAL DUG WELL AND THE DIRECTIONAL DUG WELL (SDDW)

| LENGTH (FEET) | WIDTH (FEET) | DEPTH (FEET) | POROSITY (DIMENSIONLESS) | VOLUME (CUBIC FEET) | VOLUME (GALLONS) |
|---|---|---|---|---|---|
| TRADITIONAL DUG WELL | | | | | |
| 7 SQUARE FEET (36-IN DIAM) | | 10 | 1 (OPEN HOLE) | 70 | 524 |
| DIRECTIONAL DUG WELL (SDDW) | | | | | |
| 15 | 3 | 10 | 0.25 | 112.5 | 842 |
| 30 | 3 | 10 | 0.25 | 225 | 1,683 |
| 50 | 3 | 10 | 0.25 | 375 | 2,805 |

FIG. 3

TYPICAL FLOW RATES INTO TRADIATIONAL DUG WELLS AND THE DIRECTIONAL DUG WELL (SDDW)

| LENGTH (FEET) | DEPTH (FEET) | HYDRAULIC CONDUCTIVITY (FEET/DAY)† | GRADIENT (FEET/FEET) | FLOW VOLUME (CUBIC FEET/DAY) | FLOW VOLUME (GALLONS/ DAY) |
|---|---|---|---|---|---|
| TRADITIONAL DUG WELL | | | | | |
| 7 SQUARE FEET (36-IN DIAM) | | 10 | 0.05 | 3.5 | 26 |
| 7 SQUARE FEET (36-IN DIAM) | | 3 | 0.05 | 1 | 8 |
| DIRECTIONAL DUG WELL (SDDW) | | | | | |
| 15 | 10 | 10 | 0.05 | 75 | 560 |
| 30 | 10 | 5 | 0.05 | 75 | 560 |
| 50 | 10 | 3 | 0.05 | 75 | 560 |

† TYPICAL FOR THE NEW ENGLAND REGION AND ELSEWHERE (MAINE GEOLOGICAL SURVEY 2012)

FIG. 4

SAFE, DIRECTIONAL, DROUGHT-RESISTANT DUG WELL (SDDW)

CROSS-REFERENCE TO RELATED APPLICATION(S)

This application is related to and claims the benefit of priority to U.S. Provisional Application Ser. No. 61/980,503 filed Apr. 16, 2014 in the U.S. Patent and Trademark Office, the contents of which are incorporated herein by reference.

STATEMENT OF GOVERNMENT INTEREST

The invention described herein may be manufactured, used, and licensed by or for the U.S. Government for governmental purposes without payment of any royalties thereon.

BACKGROUND

The present invention relates in general to dug wells.

Traditionally, dug wells for domestic use have been constructed with large-diameter (36-inch) concrete "tiles" stacked in a 20 to 30 foot deep vertical hole in the ground that intersects the water table at some depth (Commonwealth of Massachussetts 2008; Maine Geological Survey 2012). This type of well is problematic for several reasons.

First, the water table can fluctuate by several feet annually. This can reduce the available water by more than 30 percent, or more in dry periods, potentially resulting in several days without adequate water supply. Second, the water enters the well from the bottom through an open-bottom tile placed on crushed stone or directly on native materials, limiting the flux face (the opening through which water enters the well). If the well is located in geologic materials with low hydraulic conductivity, the well will be low yield and may not provide adequate supply. Further, traditional dug wells are round (non-directional), which at first glance seems desirable because water can flow into the well from any direction. However, groundwater typically comes into the well primarily from the area upgradient of the hole. Because the geologic material (sediment) often is of low permeability, these wells are limited by the available inflow area (flux face) and by their relatively low storage capacity. Third, the traditional dug well is susceptible to contamination from bacteria. The combination of stacking large diameter well tiles made of concrete, and a typically inadequate concrete seal at the well cap on the top of the well, often results in unsanitary seals, allowing insects, rodents, and runoff carrying bacteria to enter the well.

Also, anoxic and alkaline aquifers in some parts of the United States commonly contain high concentrations of arsenic (Ayotte et al. 2003; Ayotte et al. 1999; Ayotte et al. 2006; Flanagan et al. 2012; Montgomery et al. 2003; Nuckols et al. 2011; Smedley and Kinniburgh 2005; Welch and Stollenwerk 2003). For example, high concentrations of arsenic are known to affect 20 to 30 percent of private drilled wells in Maine and New Hampshire, as well as other parts of the United States. It is estimated that more than 100,000 people use private drilled wells in eastern New England that have unsafe levels of arsenic (Ayotte et al. 2003). As a result, many state and local agencies have been looking for ways to mitigate arsenic problems in private domestic wells.

Thus, traditional dug wells commonly have poor yield, are subject to drought failure, and often contain bacteria or other contaminants. An improved well design is needed to provide safe drinking water in larger quantities.

SUMMARY

The Safe, Directional, Drought-Resistant Dug Well (SDDW) described herein produces useful volumes of water for drinking water supply for domestic use without the typical yield and bacteria problems associated with traditional dug wells. The SDDW uses directional (non-vertical) technology that maximizes well yield, enables installation in a wide variety of settings, minimizes concentrations of known contaminants having geologic sources such as arsenic (which is common in drilled wells in New England and elsewhere), and is completely sanitary and low cost.

The SDDW involves construction of a high-permeability aquifer within a native aquifer and the use of directional orientation, perpendicular to groundwater flow, to ensure sufficient yield over a wide range of hydrologic conditions. The "constructed aquifer" also functions as a storage reservoir below the ground.

The SDDW is constructed by digging a hole that resembles a deep horizontal trough, into which a well and horizontal collectors (which provide directional orientation) are inserted. Then, the hole is backfilled with permeable crushed stone that is covered with a geotextile filter fabric. The hole is topped off with clay loam, a well casing seal of bentonite clay or similar material, and then covered with fine-grained soil. It also uses potable-water-grade PVC piping, a submersible pump, and a sanitary sealed and vented cap to prevent bacteriological contamination while in use.

Groundwater flows in response to a gradient and, in most settings, there is a dominant direction of groundwater flow. With respect to yield, traditional dug wells receive inflow from, typically, a 7-square-foot (36-inch diameter) round flux face at the bottom of the well. A round design with inflow from the bottom does not take advantage of that flow direction because water flows into the well through a relatively small area (7 square feet) at the bottom of the well, thereby limiting the amount of available water that can be captured by the well.

In contrast, the SDDW uses a horizontal well system (the side-laying rectangular flux or flow face and the horizontal collector system) to intercept water through a much larger area (over 200 square feet per side), and is perpendicular to the direction of groundwater flow. This allows the SDDW to intercept far greater amounts of water than traditional dug wells by receiving inflow from the sidewalls and bottom of the well. The flux face of the up-gradient wall ranges from 150 (15 foot length by 10 foot depth) to 500 (50 foot length by 10 foot depth) square feet. Thus, applying Darcy's Law ($Q=KAdh/dl$, where Q is rate of water flow in volume per time; K is hydraulic conductivity in length per time; A is flow area or area of flux face in length squared; and dh/dl is a dimensionless hydraulic gradient), with equal hydraulic conductivity and hydraulic gradients, the SDDW can capture 10 to 100 times more water than a traditional dug well—due primarily to the larger flux face. Additionally, the SDDW benefits from inflow of water through the bottom and sides of the well excavation. This also means that the SDDW can provide useful quantities of water in geologic materials that yield so little water that a traditional dug well would not be feasible.

By taking advantage of the direction of groundwater flow at the well site and by "constructing" a high-yield area within the native aquifer materials with a sanitary, vented cap, and using a sealed 6-inch diameter casing, the issues of yield and contamination are greatly reduced. Promoting safe drinking water for private well users, the SDDW virtually eliminates typical bacteriological contaminants and, in New England, for example, is generally low in concentrations of geologic contaminants such as arsenic. Low arsenic concentrations are a result of the geochemistry of the water that the shallow SDDW collects compared to water that is typical of deep, drilled wells. The SDDW captures well-oxygenated water that typically is slightly acidic and not conducive to the dissolution and mobilization of arsenic (Smedley and Kinneburgh, 2005; Welch and Stollenwerk, 2003; Ayotte and others, 2003). Thus, the geochemistry of the aquifer and groundwater controls the mobility of arsenic and other geologically sourced contaminants. Similar geologic and hydrologic conditions exist in other parts of the United States and in other countries.

In accordance with an embodiment of the invention, there is provided a shallow well structure for supplying high yield, generally contaminant-free drinking water from a directional dug well bore. The well structure includes one or more slotted horizontal collectors connected laterally to a cross fitting connector. A vertical well bore is dug under a land surface perpendicular to dominant groundwater flow in a water-bearing subterranean formation. The well bore is generally rectangular in shape and is wide enough to receive the horizontal collectors connected to the cross fitting connector to create a flux face that produces a high yield of drinking water. A well casing is connected to a top of the fitting connector. The fitting connector with the horizontal collectors and the well casing join together to form a unit. The fitting connector of the unit is positioned adjacent to a bottom of the well bore such that the horizontal collectors are perpendicular to the dominant groundwater flow and the well casing extends vertically from the fitting connector to above the land surface. A high-permeability crushed-stone fill is deposited in a lower portion of the well bore to surround the well casing and the horizontal collectors and allow the groundwater to flow down and into the slots of the horizontal collectors. A geotextile filter fabric is placed over the crushed-stone fill. A pump is placed in the well casing within the fitting connector to pump the groundwater captured by the horizontal collectors up the well casing to the land surface. A seal is placed around the well casing just under the land surface to prevent movement of contaminants downward along the well casing. A loam soil fill is deposited over the geotextile filter fabric to provide low-permeability confinement over the crushed-stone fill. A removable cap with a rubber seal is placed over a top of the well casing to prevent entry of contaminants.

In accordance with another embodiment of the invention, there is provided a method of completing a shallow well structure for supplying high yield, contaminant-free drinking water from a directional dug well bore. The method includes connecting one or more slotted horizontal collectors to a fitting connector, and connecting a well casing to a top of the fitting connector. The fitting connector with the horizontal collectors and the well casing form a unit. A vertical well bore is dug under a land surface perpendicular to a dominant groundwater flow in a water-bearing subterranean formation. The well bore has a generally rectangular shape and is wide enough to receive the horizontal collectors connected to the fitting connector to maximize an area available to capture the groundwater flow and produce a high yield of drinking water. The fitting connector of the unit is placed adjacent to a bottom of the well bore such that the horizontal collectors are perpendicular to the dominant groundwater flow and the well casing extends vertically from the fitting connector to above the land surface. Crushed stones are deposited into a lower portion of the well bore to provide a high-permeability crushed-stone fill surrounding the well casing and the horizontal collectors that allows the groundwater to flow down and into the slots of the horizontal collectors. The crushed-stone fill is covered with a geotextile filter fabric. A pump is placed in the well casing within the fitting connector to pump the groundwater captured by the horizontal collectors up the well casing to the land surface. A seal is placed around the well casing just under the land surface to prevent movement of contaminants downward along the well casing. A loam soil fill is deposited over the geotextile filter fabric to provide low-permeability confinement over the crushed-stone fill. A removable cap with a rubber seal is placed over a top of the well casing to prevent entry of contaminants.

BRIEF DESCRIPTION OF THE DRAWINGS

Various aspects and advantages of the invention will become apparent from the following detailed description, taken in conjunction with the accompanying drawings. The drawings are not necessarily drawn to scale. In the drawings:

FIG. 3 is a table illustrating the volume of water that can be stored in the SDDW as compared with a traditional dug well; and FIG. 4 is a table illustrating flow volume for the SDDW as compared with a traditional dug well.

DETAILED DESCRIPTION OF THE PREFERRED EMBODIMENTS

Figure 1:
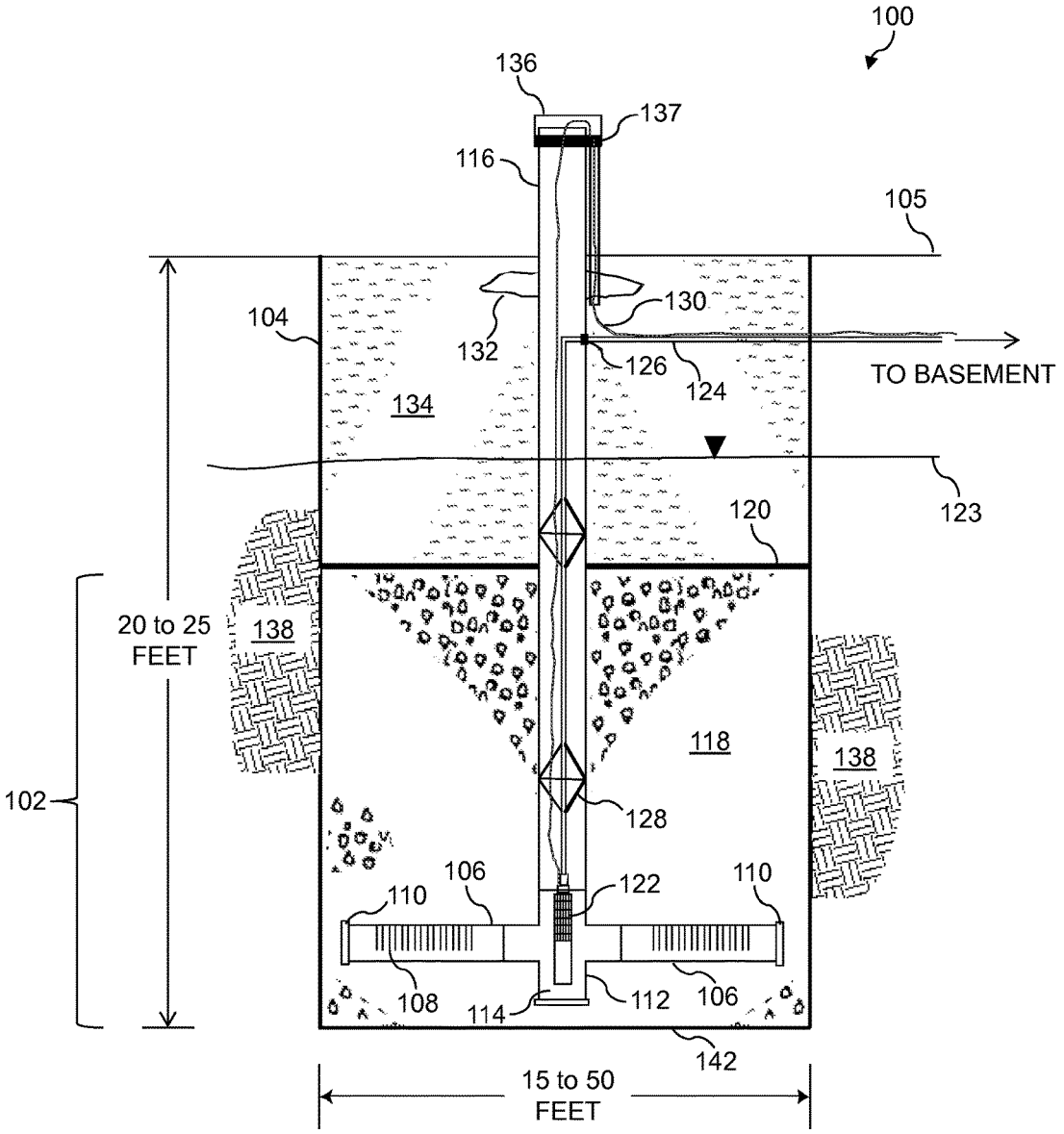
FIG. 1 is a schematic diagram of a Safe, Drought-Resistant, Dug Well (SDDW), according to an embodiment of the invention.

Referring to FIG. 1, the Safe, Drought-Resistant, Dug Well (SDDW) 100 described herein maximizes the area available to intercept water and couples that with a subterranean "constructed aquifer" 102 used to store the intercepted water for immediate use. This eliminates the issue of low hydraulic conductivity associated with many aquifer materials by allowing a significantly greater area of the aquifer to continuously contribute water to the constructed aquifer 102.

In constructing the SDDW 100, a large hole or trench (i.e., well bore) 104 is dug under a land surface 105 with an excavator or backhoe. Trench excavation is perpendicular to dominant groundwater flow direction to maximize groundwater flux face and capture of groundwater flow.

One or more collectors 106 with slots 108 are placed perpendicular to the groundwater flow to maximize yield and resist drought conditions. Two horizontal collectors are illustrated in FIG. 1. The slots 108 are about 0.125 in. in width. The length of the collectors 106 is adjusted to meet desired yield. The collectors 106 of the SDDW 100 provide the lowest possible access of water in the well which, together with the constructed aquifer 102, helps minimize effects of drought—a problem that commonly affects traditional dug wells. End caps 110 are placed on the ends of the collectors 106 to prevent entry of stone, sediment, or root material. A fitting connector 112, such as a cross fitting connector, made of polyvinyl chloride (PVC), for example, is placed between the collectors 106 to provide a sump 114 to catch any sediment that may enter the well and screen system.

A well casing 116 is connected to the top of the fitting connector 112. In one embodiment, the well casing 116 is a 6-in. potable-water-grade sch. 40 PVC casing that is corrosion resistant. The well casing 116 and the collectors 106 are attached to the fitting connector 112 by being glued or fastened with screws or bolts, for example. In the embodiment shown in FIG. 1, the well casing 116 and the collectors 106 connected to the fitting connector 112 form an inverted T-shape.

The hole or trough 104 is backfilled with a high-permeability crushed stone fill 118. The crushed stones have a diameter of about 0.75 in., and the porosity of spaces between the stones is about 0.2 to 0.25. The crushed stone fill 118 is covered with a geotextile filter fabric 120.

A submersible or suction-type pump 122 is placed in the well casing 116. The pump 122 can have a lower horsepower (e.g., about 0.50 HP) than deep well pumps, which reduces costs. Also, because the casing 116 is only 6-inch, for example, in diameter (as compared to a 36-inch diameter casing in traditional dug wells), the pump 122 does not need to be shrouded for water-flow cooling to be effective. The sump 114 also provides extra space, if needed, for the submersible pump 122. The sump 114 at the base of the vertical casing 116, just below the collectors 106, serves to trap any sediment that might make its way toward the pump 122. The sump can be cleaned out if necessary with a suction pump or with a compressed air line. The geotextile filter fabric 120, the crushed-stone fill 118, the collectors 106, the sump 114, and the pump 122 are placed below a water table 123.

A supply line or pipe 124, for example, a 1-in. polyethylene pipe, is connected to the pump 122 to provide a water supply. The supply line 124 exits a side of the well casing 116 through a pitless adapter 126 and extends to, for example, a basement of a home. Torque arresters 128 prevent twisting of the supply line pipe 124 as the pump 122 cycles on and off, and they also keep the pump 122 centered in the well casing 116. A pump electrical line 130 extends from the submersible pump 122 to a source of electricity.

A well casing seal 132, such as a bentonite clay seal, is placed around the well casing 116 just under the land surface 105 to prevent movement of contaminants downward along the well casing 116 (along with site grading). A loam soil fill (e.g., clay or silt) 134 is deposited over the geotextile filter fabric 120 to provide a low-permeability confining unit over the high-permeability crushed stone fill 118. The geotextile filter fabric 120 provides a barrier between the loam soil fill 134 and the crushed-stone fill 118, preventing downward movement of the loam soil fill 134 into the crushed-stone fill 118.

A sanitary cap 136 with a vent and a rubber seal 137 is placed over the top of the well casing 116 to prevent entry of insects and rodents. Native material 138 (e.g., low-permeability glacial deposits) covers the constructed aquifer 102 and blends with the native landscape.

Thus, a high-yield aquifer is essentially created within, and fed by, the natural aquifer. This combination of construction of a high-yield aquifer volume within the natural material serves to enhance groundwater flow and withdrawal from comparatively low-permeability materials.

Figure 2:
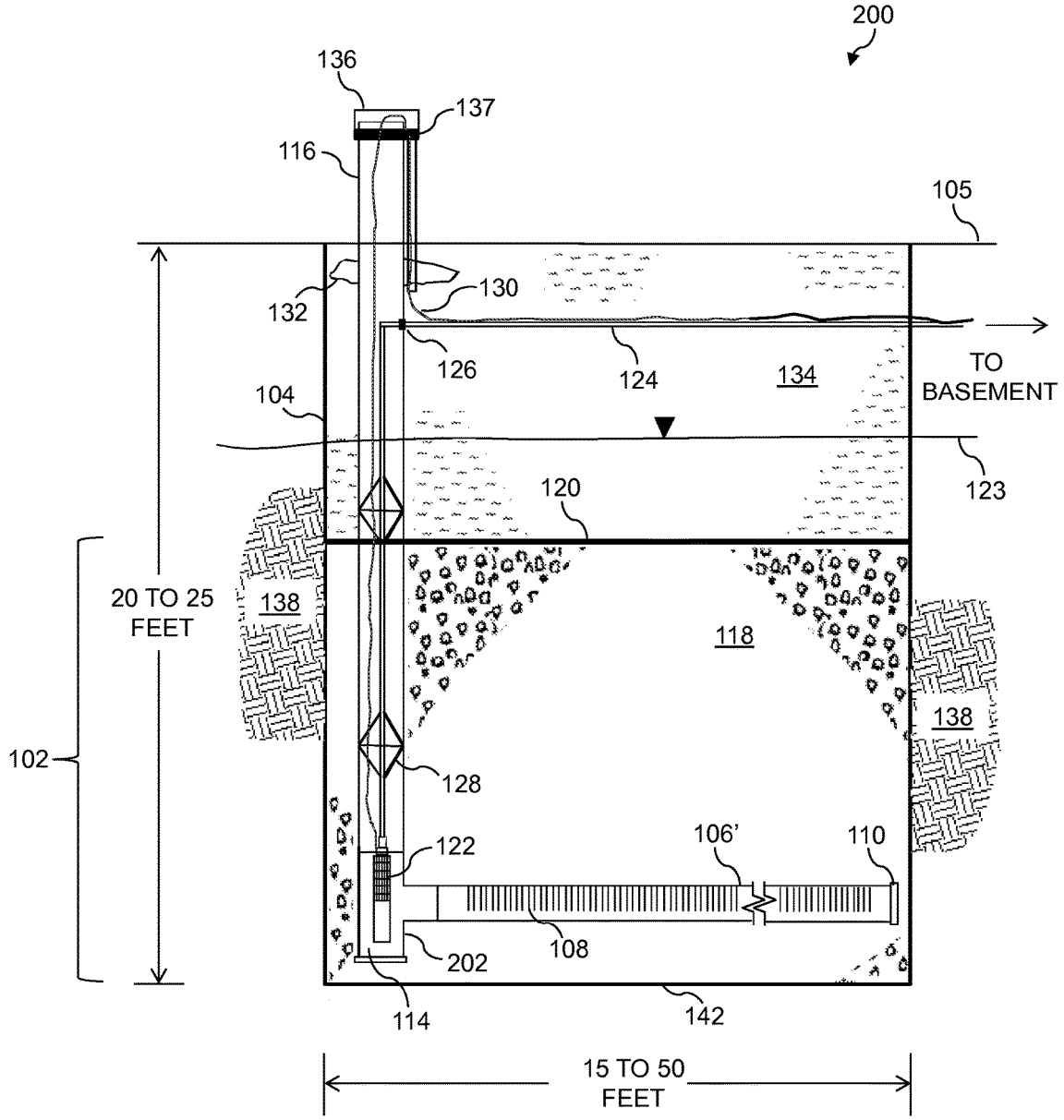
FIG. 2 is a schematic diagram of the SDDW, according to another embodiment of the invention.

In another embodiment illustrated in FIG. 2, an SDDW 200 uses one horizontal collector 106', and the casing 116 and the collector 106' are joined to an elbow fitting connector 202 to form a "sideways L" (long side down) shape. As long as the length of the collectors is sufficient to meet yield requirements, the length and shape of the collectors can be varied to accommodate depth, hydraulic, design, or other limitations and considerations. For example, the collectors can be entirely linear (horizontal) or they can form an arc or S-shape to fit the landscape or building considerations, or the unique groundwater flow situations.

Before constructing the SDDW 100, 200, its location on the landscape (generally near where the water will be used) is determined. Next, using land-surface topography as a guide or other information as available (detailed water levels or a water table map), the general direction of groundwater flow near the proposed well is determined. Then, the needed length of the well is staked out perpendicular to the general direction of groundwater flow (the length is slightly longer than the desired length of the collectors 106, 106'), and the hole 104 is dug as deep as needed for the desired length.

The hole 104 that is dug is both deep and wide, forming a rectangular hole in the earth and permitting the installation of the vertical well pipe or casing 116 with the collector pipes 106, 106' attached to the fitting connector 112 at the bottom of the well casing 116 (in the bottom of the hole 104). This rectangular configuration creates a flux face (area) that can intercept groundwater as it flows toward and past the well casing 116, allowing it to be captured by the collectors 106 and pumped out of the vertical casing 116 with the pump 122.

The flux face is the vertical area of the well that is bounded by the water table 123 (at the top) and a bottom 142 of the well, which is equal to the effective saturated thickness of the well. It is essentially the width times the depth of the hole 104. For example, in a traditional dug well, a saturated thickness of 10 feet and a width or radius of 5 feet would result in a flux face of 50 square feet. However, in the SDDW 100, 200 of the present invention, the same saturated thickness of 10 feet would be extended for 20 feet due to the collectors 106, 106', resulting in a flux face of 200 square feet—a four-fold increase in the flux face. This not only provides more water directly to the well and the collectors 106, 106', but the larger flux face combined with the collectors 106, 106' also minimizes the drawdown (the reduction of the saturated thickness) as a result of pumping, which allows more of the saturated thickness to be used, further increasing the yield of the SDDW 100, 200.

In a traditional dug well, the amount of water available for immediate use is the height of the water column above the bottom of the well multiplied by the area of the tile (3.14*radius squared). For example, a 10 foot water column and a radius of 1.5 feet would yield 10 ft*3.14*1.5*1.5=71 cubic feet or 530 gallons in storage in the well.

In the SDDW 100, 200, the pore spaces between the stones of the crushed-stone fill 118 provide the natural storage for groundwater while providing competent, maintenance-free storage. Because the pore spaces are sufficiently large, the water in storage can flow easily to the well casing 116 buried within the stone and can be pumped out for immediate use. The volume of water that can be stored in the constructed aquifer 102 is 1.5 to 6 times larger than in a traditional dug well, as shown in the table in FIG. 3. FIG. 3 shows the amount of water in storage (immediately available) in a traditional dug well and in the SDDW 100. For example, for a SDDW having a length of 15 feet, a width of 3 feet, a water column depth of 10 feet, and a crushed-stone fill porosity of 0.25, the volume of water stored is 15*3*10*0.25=112.5 cu ft. There are 7.48 gallons of water in a cubic foot. Thus, this well can store 112.5 cu ft*7.48 gal/cu ft=842 gallons of water. As another example, if the well has a length, width, and water column depth of 15 feet, respectively, and a porosity of 0.2, the well can store 5,049 gallons of water.

Thus, even in low-yielding materials, a large amount of water can be stored and even more can be captured because the area contributing groundwater to the constructed aquifer 102 and well is so large. To illustrate how the SDDW 100, 200 can capture larger amounts of groundwater flow, the table in FIG. 4 shows example calculations that use a range of values for aquifer hydraulic conductivity and contributing areas and an assumed gradient of 0.05. FIG. 4 shows typical flow rates into traditional dug wells and into the SDDW 100, 200, which illustrates the order-of-magnitude differences in flow volume.

In addition, the SDDW 100 can be installed in a range of depths, limited only by the depth to the water table 123 (and its range of seasonal fluctuation) and by the depth to which available machinery can dig the well (typically up to 25 to 30 feet in depth). These methods (constructed aquifer methods and directional design) used in the SDDW 100, 200 bring much-needed constructed aquifer techniques and directional design to domestic well construction. These methods are also suitable for some public-well installations, particularly where shallow or low-permeability aquifer conditions prevail.

The constructed aquifer 102 and the directional orientation of the collectors 106, 106' beneath the ground surface 105 make the system simultaneously viable over a wide range of hydrologic and hydraulic conditions, drought resistant, and extremely sanitary—keeping insects and animals out of and away from the groundwater.

The directionally oriented collectors 106, 106', whose length can be specified to match demand requirements, and the crushed-stone fill 118 storage reservoir act in concert to minimize drawdown of the water table 123 during pumping by accessing water within the highly transmissive crushed stone. This enables installation in shallow aquifer settings. Further, the directional design increases both flux and storage of groundwater by at least one order of magnitude over traditional designs. The non-directional circular traditional wells miss the opportunity to collect and store large volumes of groundwater that continually flow past the well. By increasing the length of the design dimensions of the directional collectors 106, 106', more water can be made available.

Because groundwater generally flows horizontally in the ground, collecting water in a traditional circular well is akin to collecting water from one point on the landscape. With the SDDW 100, 200, water is collected from about 15 to 50 feet of buried horizontal slotted PVC pipe, typically 15 to 20 feet below the ground and perpendicular to groundwater flow, allowing for large volumes of water to be stored and pumped as needed for water supply in a domestic setting. This is akin to collecting groundwater from a line of points rather than a single point on the landscape.

The SDDW 100, 200 increases both groundwater flux to the domestic dug well and maximizes the amount of groundwater in storage for immediate use by the well owner. This makes the SDDW 100, 200 deployable in a wide variety of hydraulic conditions (i.e., low- to high-yield aquifer settings) to ensure that the well provides adequate water in the typical range of hydrologic conditions. The sanitary superiority of the SDDW 100, 200 is a major improvement over the traditional dug well—virtually eliminating the introduction of coliform and *E. Coli* bacteria.

Also, the water collected from the shallow ground using the SDDW 100, 200 is generally well oxygenated and often slightly acidic—conditions that are not conducive to dissolving arsenic in groundwater—unlike deep, anoxic, and slightly alkaline aquifers in some parts of the United States that commonly contain high concentrations of arsenic.

Thus, with the SDDW 100, 200, large volumes of water can be collected, stored, and utilized while effectively eliminating bacteriological contaminants and reducing other contaminants (arsenic, for example). Further, the SDDW 100, 200 can be easily constructed with common equipment and materials. Because of this, the SDDW 100, 200 is generally more economical to construct than other well types.

Further, orienting the well construction such that the flux face is perpendicular to the dominant direction of groundwater flow maximizes recharge (groundwater flow) to the well and surrounding stone after the well has been in use for a period of time (large withdrawals, say for lawn or garden watering, showering, etc). This feature is increasingly important in sloped land surface applications, common in rural areas.

The SDDW 100, 200 has several advantages, including:

(a) the directional flow-capturing design using the collectors 106, 106' allows for the capture and safe storage of significantly more groundwater flow than with traditional dug well design;

(b) the constructed underground storage reservoir (aquifer) 102 made of crushed stone and sealed prevents contaminant entry and provides for the dynamic storage of water;

(c) the vertical well casing or riser pipe 116 is sealed with a vented sanitary cap 136 that reduces entry points for bacteria;

(d) the SDDW 100, 200 reduces the potential for contaminants derived from geologic sources, such as arsenic and manganese, due to capture of toxic, shallow-aquifer water with a geochemistry that is not compatible with dissolution of those contaminants;

(e) the SDDW 100, 200 can be used at a broader range of sites as compared with traditional dug wells;

(f) the SDDW 100, 200 can use a smaller diameter vertical well casing or riser 116 as compared with traditional dug wells; and (g) the SDDW 100, 200 can be sized to meet nearly any domestic water demand.

It will be appreciated by those skilled in the art that modifications and variations of the present invention are possible without departing from the principles and spirit of the invention, the scope of which is defined in the appended claims and their equivalents.

GENERAL BIBLIOGRAPHY ON THE SUBJECT

The following bibliography provides citations to the references cited in the above text. The references are provided merely to clarify the description of the present invention and citation of a reference either in the bibliography below or in the specification above is not an admission that any such reference is "prior art" to the invention described herein.

Ayotte, J. D., Montgomery, D. L., Flanagan, S. M. and Robinson, K. W. (2003) Arsenic in groundwater in eastern New England: occurrence, controls, and human health implications. Environmental Science & Technology, 37(10), 2075-2083.

Ayotte, J. D., Nielsen, M. G., Robinson, G. R., Jr. and Moore, R. B. (1999) Relation of arsenic, iron, and manganese in ground water to aquifer type, bedrock lithogeochemistry, and land use in the New England coastal basins. U.S. Geological Survey Water—Resources Investigations Report 99-4162, pp. 30.

Ayotte, J. D., Nolan, B. T., Nuckols, J. R., Cantor, K. P., Robinson, G. R., Baris, D., Hayes, L., Karagas, M., Bress, W., Silverman, D. T. and Lubin, J. H. (2006) Modeling the probability of arsenic in groundwater in New England as a tool for exposure assessment. Environmental Science & Technology, 40(11), 3578-3585.

Commonwealth of Massachussetts (2008) Private Well Guidelines. http://www.mass.gov/dep/water/laws/prwell-gd.pdf (accessed Jul. 27, 2013).

Flanagan, S. F., Ayotte, J. D. and Robinson, G. R., Jr. (2012) Quality of water from crystalline rock aquifers in New England, New Jersey, and New York, 1995-2007. U.S. Geological Survey Scientific Investigations Report 2012-5220, pp. 104.

Maine Geological Survey (2012) Maine's Dug Wells. http://www.maine.gov/doc/nrimc/mgs/explore/water/facts/mar11.htm (accessed Jul. 27, 2013).

Montgomery, D. L., Ayotte, J. D., Hamlin, P. and Caroll, P. R. (2003) Arsenic concentrations in private bedrock wells in Southeastern New Hampshire. U.S. Geological Survey Fact Sheet FS-051-03, pp. 8.

Nuckols J. R., Freeman L. E., Lubin J. H., Airola M. S., Baris D., Ayotte J. D., Taylor A., Paulu C., Karagas M. R., Colt J., Ward M. H., Huang A. T., Bress W., Cherala S., Silverman D. T., Cantor K. P. Estimating water supply arsenic levels in the New England bladder cancer study. Environ Health Perspect. 2011 September; 119(9):1279-85.

Smedley, P. L., and Kinniburgh, D. G. (2005). Chapter 11: Arsenic in groundwater and the environment 263-299 In: Essentials of Medical Geology. Selinus, O., Alloway, B., Centeno, J. A., Finkelman, R. B., Fuge, R., Lindh, U., and Smedley, P. L. (editors). (Amsterdam: Elsevier Academic Press.)

Welch, A. H. and Stollenwerk, K. G. (2003). Arsenic in Groundwater: Geochemistry and Occurrence. Boston: Kluwer.

What is claimed is:

1. A shallow well structure for providing high yield, contaminant-free drinking water from a dug well bore, comprising:

a fitting connector;

one or more slotted horizontal collectors connected to the fitting connector;

a vertical well bore, dug under a land surface perpendicular to an aquifer in a water-bearing subterranean formation, the well bore having a generally rectangular shape and being wide enough to receive the horizontal collectors connected to the fitting connector to create a flux face that produces a high yield of drinking water;

a well casing connected to a top of the fitting connector, the fitting connector with the horizontal collectors and the well casing joined together to form a unit, the fitting connector of the unit positioned adjacent to a bottom of the well bore such that the horizontal collectors are perpendicular to the dominant groundwater flow and the well casing extends vertically from the fitting connector to above the land surface;

a high-permeability crushed-stone fill deposited in a lower portion of the well bore to surround the well casing and the horizontal collectors and allow the groundwater to flow down and into the slots of the horizontal collectors;

a geotextile filter fabric placed over the crushed-stone fill;

a pump placed in the well casing within the fitting connector to pump the groundwater captured by the horizontal collectors up the well casing to the land surface;

a seal placed around the well casing just under the land surface to prevent movement of contaminants downward along the well casing;

a loam soil fill deposited over the geotextile filter fabric to provide low-permeability confinement over the crushed-stone fill; and a vented, removable cap with a rubber seal placed over a top of the well casing to prevent entry of contaminants.

2. The shallow well structure of claim 1, further comprising a sump formed by the fitting connector and located at a base of the fitting connector and below a level of the horizontal collectors to trap sediment before reaching the pump.

3. The shallow well structure of claim 2, wherein the geotextile filter fabric, the crushed-stone fill, the horizontal collectors, the sump, and the pump are placed within the well casing below a water table.

4. The shallow well structure of claim 1, further comprising placing end caps at outer ends of the horizontal collectors to prevent entry of stone, sediment, or root material.

5. The shallow well structure of claim 1, further comprising a supply pipe connected to the pump and extending up and out of the well casing and well bore to withdraw the water from the well structure.

6. The shallow well structure of claim 5, further comprising one or more torque arrestors disposed along the supply pipe to prevent twisting of the supply pipe as the pump cycles on and off and to center the pump in the well casing.

7. The shallow well structure of claim 1, further comprising a pump electrical line extending upward from the pump to a source of electricity.

8. The shallow well structure of claim 1, wherein the seal is made of bentonite clay.

9. The shallow well structure of claim 1, wherein the crushed-stone fill provides a storage reservoir for groundwater that flows to the horizontal collectors and is pumped out for use.

10. The shallow well structure of claim 1, wherein the flux face is a vertical area of the well bore bounded at a top of the flux face by a water table and at a bottom of the flux face by a bottom of the well bore, and the flux face is perpendicular to the an aquifer.

11. The shallow well structure of claim 1, wherein the fitting connector is a cross fitting connector and the one or more horizontal collectors comprise two horizontal collectors connected laterally to the cross fitting connector, and the well casing and the two horizontal collectors connected to the cross fitting connector form an inverted T-shape.

12. The shallow well structure of claim 1, wherein the fitting connector is an elbow fitting connector and the one or more horizontal collectors comprise one horizontal collector connected laterally to the elbow fitting connector, and the well casing and the one horizontal collector connected to the elbow fitting connector form an L-shape.

13. The shallow well structure of claim 1, wherein the loam soil fill is a clay, silt, or fine-sand fill.

14. A method of completing a shallow well structure for providing high yield, contaminant-free drinking water from a directional dug well bore, comprising:

connecting one or more slotted horizontal collectors to a fitting connector;

connecting a well casing to a top of the fitting connector, the fitting connector with the horizontal collectors and the well casing forming a unit;

digging a vertical well bore under a land surface perpendicular to an aquifer in a water-bearing subterranean formation, the well bore having a generally rectangular shape and being wide enough to receive the horizontal collectors connected to the fitting connector to maximize an area available to capture the groundwater flow and produce a high yield of drinking water;

placing the fitting connector of the unit adjacent to a bottom of the well bore such that the horizontal collectors are perpendicular to the an aquifer and the well casing extends vertically from the fitting connector to above the land surface;

depositing crushed stones into a lower portion of the well bore to provide a high-permeability crushed-stone fill surrounding the well casing and the horizontal collectors that allows the groundwater to flow down and into the slots of the horizontal collectors;

covering the crushed-stone fill with a geotextile filter fabric;

placing a pump in the well casing within the fitting connector to pump the groundwater captured by the horizontal collectors up the well casing to the land surface;

placing a seal around the well casing just under the land surface to prevent movement of contaminants downward along the well casing;

depositing a loam soil fill over the geotextile filter fabric to provide low-permeability confinement over the crushed-stone fill; and placing a vented, removable cap with a rubber seal over a top of the well casing to prevent entry of contaminants.

15. The method of claim 14, wherein said connecting slotted horizontal collectors to a fitting connector creates a sump located at a base of the well casing and below a level of the horizontal collectors, and traps sediment entering through the slots of the horizontal collectors before reaching the pump.

16. The method of claim 15, wherein the geotextile filter fabric, the crushed-stone fill, the horizontal collectors, the sump, and the pump are placed within the well casing below a water table.

17. The method of claim 14, wherein said depositing crushed stones into a lower portion of the well bore to provide a high-permeability crushed-stone fill provides a natural storage reservoir for groundwater that flows to the horizontal collectors and is pumped out for use.

18. The method of claim 14, wherein the groundwater captured by the shallow well structure is oxygenated and acidic, which resists dissolution of arsenic in the groundwater.

19. The method of claim 14, further comprising placing end caps at outer ends of the horizontal collectors to prevent entry of stone, sediment, or root material.

20. The method of claim 14, wherein the crushed stone is placed in the wellbore to a height of approximately half a height of the well bore.

* * * * *